US009394655B1

(12) United States Patent
Wright, Jr.

(10) Patent No.: US 9,394,655 B1
(45) Date of Patent: Jul. 19, 2016

(54) STRIPING SYSTEMS

(71) Applicant: Steven Wright, Jr., Telford, PA (US)

(72) Inventor: Steven Wright, Jr., Telford, PA (US)

( * ) Notice: Subject to any disclaimer, the term of this patent is extended or adjusted under 35 U.S.C. 154(b) by 0 days.

(21) Appl. No.: 14/446,275

(22) Filed: Jul. 29, 2014

(51) Int. Cl.
*E01C 23/16* (2006.01)
*E01C 23/22* (2006.01)

(52) U.S. Cl.
CPC ..... *E01C 23/22* (2013.01); *E01C 23/163* (2013.01)

(58) Field of Classification Search
CPC ..... E01C 23/22; Y10T 16/203; Y10T 16/204; Y10T 16/218
USPC ..... 404/93, 94, 111; 280/62; 16/18 A
See application file for complete search history.

(56) References Cited

U.S. PATENT DOCUMENTS 3,052,909 A 9/1962 Russell
3,122,773 A 3/1964 Little
3,352,283 A * 11/1967 Maus ..... E01C 23/22 118/301
3,605,929 A * 9/1971 Rolland ..... B62D 61/08 180/208
4,588,318 A * 5/1986 O'Brien ..... B05C 17/0308 239/578
4,624,602 A * 11/1986 Kieffer ..... E01C 23/22 118/305
4,877,348 A * 10/1989 Opie ..... E01C 23/22 118/300
6,056,306 A * 5/2000 Rust ..... B62B 7/06 280/204
7,163,353 B2 * 1/2007 Ramirez ..... E01C 23/227 239/150
7,237,783 B2 7/2007 Kieffer et al.
2009/0087263 A1 * 4/2009 Martinez ..... E01C 23/166 404/94

FOREIGN PATENT DOCUMENTS

GB 2203104 A * 10/1988 ..... B62K 5/02

OTHER PUBLICATIONS

Google images, "airless piston pump sprayer".*
"Graco Airless Paint Sprayers", http://portlandcompressor.com/airless/sprayer-pumps.aspx, dating back to May 4, 2012.*

* cited by examiner

*Primary Examiner* — Thomas B Will
*Assistant Examiner* — Katherine Chu
(74) *Attorney, Agent, or Firm* — RG Patent Consulting, LLC; Rachel Gilboy

(57) ABSTRACT

A manually operated, lightweight and portable three-wheel device that includes an airless piston pump paint-spraying system for the striping of parking lots and other paved surfaces. The device may also feature a laser-line system to ensure accurate striping, while eliminating the need for snapping chalk lines.

15 Claims, 5 Drawing Sheets

STRIPING SYSTEMS

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of striping means and more specifically relates to the Wright Striper, a manually-operable striping system.

2. Description of the Related Art

Modern society makes use of roads for transportation of vehicles. There are tens of millions of paved parking lots, large and small, in every hamlet, town, and city across America and the world for parking vehicles therein. Virtually every one of them, to be organized, safe, and useful, must be striped with parking indicator lines. For larger parking lots, a striping contractor may be called in to perform the operation with heavy equipment. On smaller lots, paving contractors may rent a striping machine and do the work themselves. Typically, even the smaller striping machines are gas-powered and noisy, putting out noxious fumes; heavy and hard to push, especially on uneven or inclined terrain; and they use five-gallon paint buckets that are both heavy and a mess to change out. A more efficient means of providing striping is desirable, especially for smaller jobs to make the task cost-effective.

Various attempts have been made to solve the above-mentioned problems such as those found in U.S. Pat. No. 7,237,783 to Joseph Kieffer et al; U.S. Pat. No. 3,122,773 to Roy B. Little et al; and U.S. Pat. No. 3,052,909 to Albert Russell et al. None of the above inventions and patents, taken either singly or in combination, is seen to describe the invention as claimed.

Ideally, a manually-operable striping system should provide ease of use and, yet would operate reliably and be manufactured at a modest expense. Thus, a need exists for a reliable manually-operable striping system to avoid the above-mentioned problems.

BRIEF SUMMARY OF THE INVENTION

In view of the foregoing disadvantages inherent in the known striping means art, the present invention provides a novel manually-operable striping system. The general purpose of the present invention, which will be described subsequently in greater detail is to provide a cost-effective means for painting (repairing, creating or maintaining) striping in small parking lots.

A manually operated, lightweight and portable three-wheel device that can be used with any airless piston pump paint-spraying system for the striping of parking lots and other paved surfaces is disclosed. More economical, more versatile, far faster and far easier to use than powered striping systems, the Wright Striper may also feature a laser-line system to ensure accurate striping, while effectively eliminating the need for snapping chalk lines The manually-operable striping system comprises: a manually-operable striping assembly comprising a frame, a rear-wheel-assembly (having a first-frame-leg, a first wheel, a second-frame-leg, and a second wheel), a front-wheel-assembly (having an axle-spindle, and a third wheel), a handle, a laser sighting device, an airless piston pump sprayer assembly (having a spray nozzle shield, a wand, a trigger assembly, a delivery hose, and a paint container). The manually-operable striping system comprises the manually-operable striping assembly. The manually-operable striping assembly comprises in functional combination the frame, the rear-wheel-assembly, the front-wheel-assembly, and the handle.

The rear-wheel-assembly provides a means for operating the airless piston pump sprayer assembly to accurately paint at least one parking line. The frame provides a mount for the rear-wheel-assembly, the front-wheel-assembly, and the handle; wherein the rear-wheel-assembly comprises in functional combination the first-frame-leg, the first wheel, the second-frame-leg, and the second wheel. The first-frame-leg attaches the first wheel to the frame. The second-frame-leg attaches the second wheel to the frame. The first wheel and the second wheel are located parallel to each other and behind the third wheel. The plurality of wheels comprises exactly the first wheel, the second wheel, and the third wheel in preferred embodiments; wherein the first wheel and the second wheel are situated so as to maintain stability during use (wide stance) and follow the third wheel when moving in a forward direction. The front-wheel-assembly comprises in functional combination the axle-spindle and the third wheel.

The axle-spindle preferably comprises a half-wishbone structure to maximize steerability; wherein the third wheel is able to provide efficient, yet simple steering. The rear-wheel-assembly and the front-wheel-assembly serve to provide motive means for the manually-operable striping system, wherein the first wheel, the second wheel, and the third wheel comprise rims with wheel bearings (or suitable equivalent); wherein the first wheel, the second wheel, and the third wheel comprise rubber and ferrous rims for durability and smooth travel during use.

The frame comprises a diamond-shaped perimeter with a bushing-extension suitable to receive the axle-spindle; the axle-spindle able to rotate within the bushing-extension to accommodate travel across a variety of terrains. The axle-spindle is situated along a substantially horizontal plane and is removable from the bushing-extension when desirable for storage. The axle-spindle is able to be locked and unlocked for accommodating various painting applications (straight or curved).

A travelling height of the manually-operable striping assembly is able to be adjusted by loosening connecting fasteners and moving the frame in relation to the rear-wheel-assembly via rotation and retightening the connecting fasteners; the frame located an increased distance above a surface to be painted when raised. The handle is able to be moved (pivoted and/or swung) in relation to the frame to appropriately manipulate the manually-operable striping assembly for pushing or pulling.

The airless piston pump sprayer assembly comprises the spray nozzle shield, the wand, the trigger assembly, the delivery hose, and the paint container all in fluid communication to deliver paint contained within the paint container to the delivery hose and into the wand when the trigger assembly is activated. The paint is delivered through the spray nozzle shield for ultimately depositing the paint onto the at least one parking line. The wand is affixed adjacent the handle during use; wherein the wand when connected with the handle is able to be used in combination to steer (and push and/or pull) the manually-operable striping assembly. The spray nozzle shield is located on a swivel at an end of the wand; wherein the spray nozzle shield directs the paint downwardly onto the at least one parking line, protecting and sheltering the paint (while being dispensed) from being displaced inappropriately by the wind. As such the spray nozzle shield is located substantially perpendicular to the at least one parking line for painting during in use conditions for accuracy in painting operations.

For ease of manufacture, shipping, use, and storage the manually-operable striping assembly comprises a mass of less than twenty pounds. To keep the present invention suitably lightweight the manually-operable striping system does not comprise a powerer. Manual power is the only means for moving the device. Painting of the at least one parking line does not require use of chalk lines because of the inclusion of the laser sighting device, thus saving time and effort in achieving straight lines. Thus, the manually-operable striping system is useful for painting the at least one parking line.

A kit is also described herein for use and sale including: the manually-operable striping assembly, the airless piston pump sprayer assembly, and a set of user instructions.

A method of using a manually-operable striping system is also disclosed herein comprising the steps of: connecting a manually-operable striping assembly to an airless piston pump sprayer assembly, filling a paint container of the airless piston pump sprayer assembly ready for use, lining up (orienting) the manually-operable striping assembly over a parking line to be painted, activating a trigger assembly to dispense paint onto the parking line, and manually pushing the manually-operable striping assembly while walking to paint the parking line, and deactivating the trigger assembly to stop flow of the paint when the parking line has been painted. The method may further comprise the steps of sighting and following a laser sighting device to paint the parking line(s).

The present invention holds significant improvements and serves as a manually-operable striping system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, manually-operable striping system, constructed and operative according to the teachings of the present invention.

The various embodiments of the present invention will hereinafter be described in conjunction with the appended drawings, wherein like designations denote like elements.

DETAILED DESCRIPTION

Figure 1:
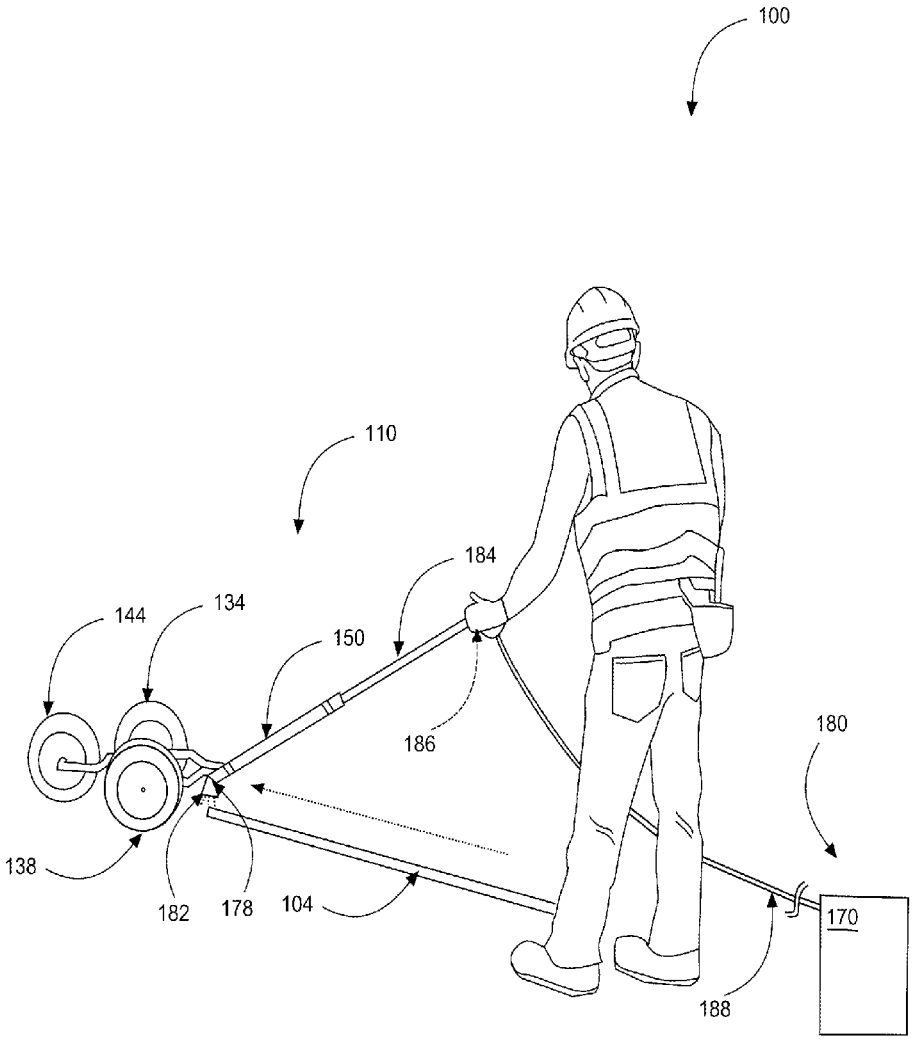
FIG. 1 shows a perspective view illustrating a manually-operable striping system in an in-use condition according to an embodiment of the present invention.

As discussed above, embodiments of the present invention relate to a striping means and more particularly to a manually-operable striping system as used to improve the cost-effective maintenance of parking lots.

Generally speaking, the Wright Striper (manually-operable striping assembly) is a walk-behind, manually operated, three-wheel apparatus intended for use with virtually any airless piston pump paint-spraying system for the striping of parking lots and other paved surfaces.

The Wright Striper is preferably a three-wheel, hand-powered cart or truck designed to work with any piston pump paint-spraying system by connecting to a Maxi-Pole spray extension which will also serve as the operative directional handle for pushing the Striper. (The Maxi-Pole is not included with the Wright Striper.) The Wright Striper is tough, durable, and fully adjustable, yet weighs only 18 pounds. The Striper is constructed with an adjustable-length steel frame, two fixed-direction rear wheels, and a multi-directional front wheel. All wheels are preferably equipped with inflatable rubber tires. The front wheel may be heavy aluminum, preferable tire size 2.80/2.50-4; and the front wheel assembly, which may be adjusted in length from the rest of the steel frame or chassis by the repositioning of through-bolts in frame slots is mounted on a heavy-duty, pivoting bearing which may itself be set for high-precision straight-line, curved, or circular tracking.

The two rear wheels, somewhat lighter and of steel construction, are likewise adjustable to the frame, and these have preferred size 4.10/3.50-4 inflatable rubber tires. The frame components, which fasten together with nuts and bolts, taper and extend to the rear of the back wheels, and terminate in a heavy-duty, 19-inch mounting bracket removably attached to a 3-foot Maxi-Pole and height-adjustable spray-tip. The Maxi-Pole mounting bracket may also incorporate an optional laser-sighting device, and this feature eliminates the need for snapping chalk lines prior to painting. The Wright Striper is light and compact at 18 pounds and a little over 3 feet in length and 16 inches in width, easy to be picked up, and transported in a pickup truck. An even lighter model might be produced in a carbon-composite material.

The Wright Striper, as depicted in the figures, gives an impression of stout, high-precision utility. The design is clean and economical; the components substantial and fully adjustable; and the materials selected for longevity in service.

The Wright Striper will work on virtually all terrains. The Striper will provide high-precision, professional results at an economical price. The optional laser-sight and marking guide will eliminate the need for snapping chalk-lines. At 18 pounds, the compact Striper can be easily carried, stored, and transported. Entirely manual, the Wright Striper requires no gasoline, and emits no fumes. Operator health and comfort are maximized, not compromised. Because the Maxi-Pole spray extension is the operative handle of the Striper, operation is light and easy. With the Wright Striper, the operator is not transporting nor changing-out 5-gallon paint buckets weighing upwards of 70 pounds.

Connected to its paint-source by only the hose and Maxi-Pole, the Wright Striper permits the operator to function remotely from the supporting machinery and materials. Engines, pumps, and paint may remain in the back of a pickup while the Wright Striper is in use. The Wright Striper leaves no tire-tracking from overspray—it works clean. The Wright Striper is high-precision, and can paint flush with a curb. Best of all, perhaps, the Wright Striper can be used to accomplish a pavement striping or marking job up to three times as fast as a conventional, heavy-machinery striping unit.

The Wright Striper may be an ideal choice for contractors engaged in paving and marking jobs, and the Wright Striper might also be successfully marketed to a wide variety of commercial and institutional establishments—from retail or office complexes with parking lots and maintenance staff, to schools that would use the Striper for lining and marking athletic fields; to small airport operations; to government agencies and municipalities.

Referring to the drawings by numerals of reference there is shown in FIG. 1, a perspective view illustrating manually-operable striping system 100 in an in-use condition (painting parking line 104) according to an embodiment of the present invention.

Manually-operable striping system 100 comprises: manually-operable striping assembly 110 comprising frame 120, rear-wheel-assembly 130 (having first-frame-leg 132, first wheel 134, second-frame-leg 136, and second wheel 138), front-wheel-assembly 140 (having axle-spindle 142, and third wheel 144), handle 150, airless piston pump sprayer assembly 180 (having spray nozzle shield 182, wand 184, trigger assembly 186, delivery hose 188, and paint container 170). As such, manually-operable striping system 100 comprises manually-operable striping assembly 110.

Manually-operable striping assembly 110 comprises in functional combination frame 120, rear-wheel-assembly 130, front-wheel-assembly 140, and handle 150. Rear-wheel-assembly 130 provides a means for operating airless piston pump sprayer assembly 180 to accurately paint at least one parking line 104. Frame 120 provides a mount for rear-wheel-assembly 130, front-wheel-assembly 140, and handle 150. Rear-wheel-assembly 130 comprises in functional combination first-frame-leg 132, first wheel 134, second-frame-leg 136, and second wheel 138. First-frame-leg 132 attaches first wheel 134 to frame 120 (outwardly from frame 120). Second-frame-leg 136 attaches second wheel 138 to frame 120 (outwardly from frame 120). Stability is increased in this way since the footprint is wider. First wheel 134 and second wheel 138 are located parallel to each other and behind third wheel 144; wherein first wheel 134 and second wheel 138 are situated so as to maintain stability during use and follow third wheel 144 (when moving in a forward direction).

Front-wheel-assembly 140 comprises in functional combination axle-spindle 142 and third wheel 144; wherein third wheel 144 is able to provide steering as necessary. Rear-wheel-assembly 130 and front-wheel-assembly 140 serve to provide motive means for manually-operable striping system 100. Frame 120 comprises a diamond-shaped perimeter 122 (in preferred embodiments) with bushing-extension 124 suitable to receive axle-spindle 142; axle-spindle 142 able to rotate within bushing-extension 124 to accommodate travel across a variety of terrains, such that a parking lot need not be necessarily completely planar. Frame 120 may comprise other shapes. Axle-spindle 142 is situated along a substantially horizontal plane and is removable from bushing-extension 124 when desirable for storage or transport between locations. Handle 150 is able to be moved in relation to frame 120 to appropriately manipulate manually-operable striping assembly 110.

Airless piston pump sprayer assembly 180 comprises spray nozzle shield 182, wand 184, trigger assembly 186, delivery hose 188, and paint container 170 all in fluid communication to deliver paint contained within paint container 170 to delivery hose 188 and into wand 184 when trigger assembly 186 is activated; the paint delivered through spray nozzle shield 182 for depositing the paint onto the at least one parking line 104. Wand 184 is affixed adjacent handle 150 during use. Spray nozzle shield 182 directs the paint downwardly onto the at least one parking line 104, as indicated, protecting and sheltering the paint from being displaced inappropriately by the wind. In this way neat parking line(s) 104 may be reliably created. Spray nozzle shield 182 is located substantially perpendicular to the parking line(s) 104 for painting, and as such manually-operable striping system 100 is useful for painting the at least one parking line 104.

Figure 2:
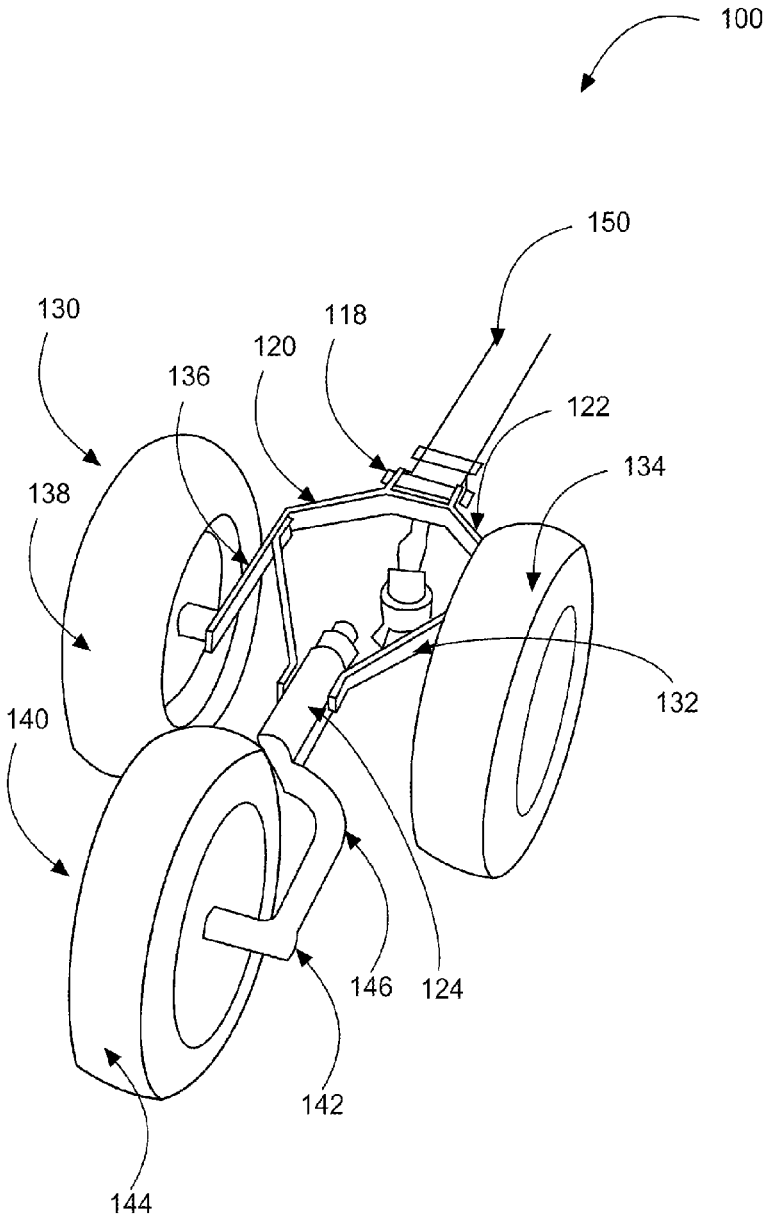
FIG. 2 is a front perspective view illustrating a manually-operable striping assembly having a frame, rear-wheel-assembly, front-wheel-assembly, and a handle according to an embodiment of the present invention of FIG. 1.

Referring now to FIG. 2, a front perspective view illustrating manually-operable striping assembly 110 having frame 120, rear-wheel-assembly 130, front-wheel-assembly 140, and handle 150 according to an embodiment of the present invention of FIG. 1.

Preferred embodiments comprise a plurality of wheels comprising exactly one of first wheel 134, second wheel 138, and third wheel 144. First wheel 134, second wheel 138, and third wheel 144 comprise rubber; however other suitable materials may be used. Axle-spindle 142 comprises a half-wishbone structure 146 to maximize 'steerability'. This feature also helps the mass of the present invention remain reasonably 'lightweight' in nature.

A travelling height of manually-operable striping assembly 110 is able to be adjusted by loosening connecting fasteners 118 and moving frame 120 in relation to rear-wheel-assembly 130. Manually-operable striping system 100 does not comprise a powerer such as an electric, fossil fuel driven combustion engine or the like. In this way the present invention is simple to maintain and cost-effective in use. Further, the device does not create any environmental impact from emissions.

Figure 3:
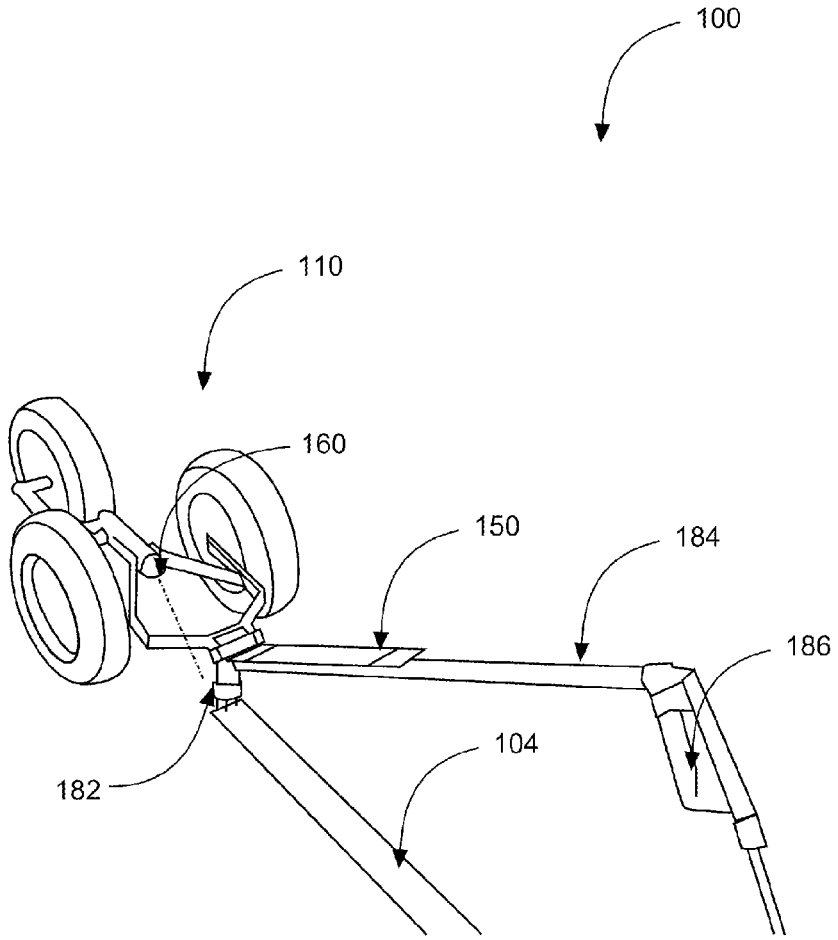
FIG. 3 is a rear perspective view illustrating the handle of the manually-operable striping assembly as affixed to a wand of an airless piston pump sprayer assembly according to an embodiment of the present invention of FIG. 1.

Referring now to FIG. 3, a rear perspective view illustrating handle 150 of manually-operable striping assembly 110 as affixed to wand 184 of airless piston pump sprayer assembly 180 according to an embodiment of the present invention of FIG. 1.

Spray nozzle shield 182 may be located on swivel 178 at an end of wand 184; wand 184 when connected with handle 150 is able to be used in combination to steer manually-operable striping assembly 110. Manually-operable striping assembly 110 comprises a mass of less than twenty pounds in preferred embodiments. Ferrous and non-ferrous versions of manually-operable striping assembly 110 may be manufactured. First wheel 134, second wheel 138, and third wheel 144 preferably comprise rims with wheel bearings. Other friction reducing means may be employed in alternate embodiments.

Figure 4:
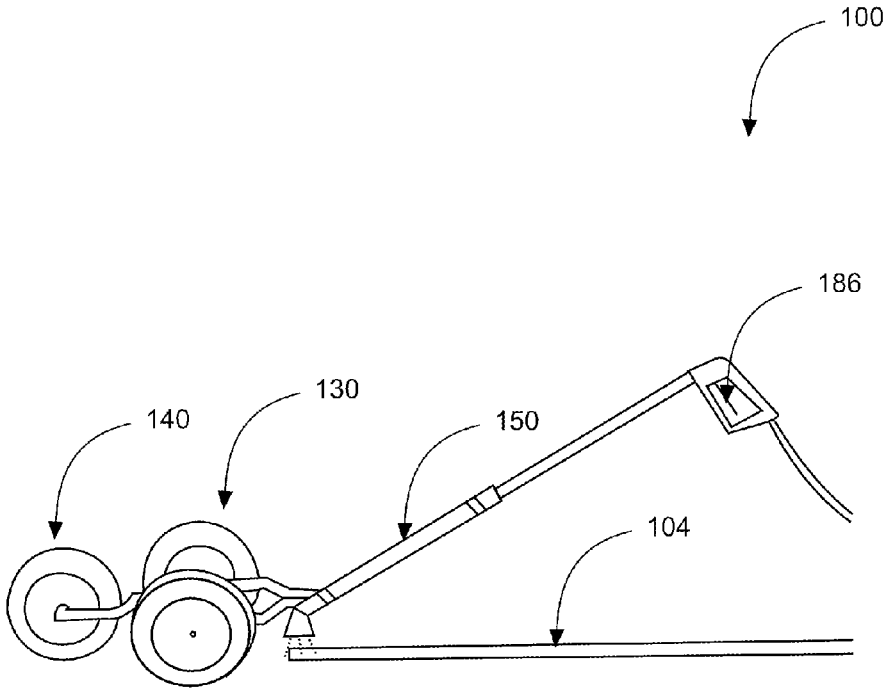
FIG. 4 is a side view illustrating the manually-operable striping assembly straddling a parking line according to an embodiment of the present invention of FIG. 1.

Referring now to FIG. 4, a side view illustrating manually-operable striping assembly 110 straddling parking line 104 according to an embodiment of the present invention of FIG. 1.

Manually-operable striping system 100 may further comprise laser sighting device 160. Those with ordinary skill in the art will now appreciate that upon reading this specification and by their understanding the art of lasers as described herein, methods of mounting and aiming will be understood by those knowledgeable in such art. Painting of the at least one parking line 104 does not require use of chalk lines because of this unique feature. Axle-spindle 142 is able to be locked for straight-line painting applications, as shown. First wheel 134, second wheel 138, and third wheel 144 do not pass over the at least one parking line 104 during the straight-line painting applications since they travel ahead of and beside parking line 104. First wheel 134, and second wheel 138 straddle the at least one parking line 104 during straight-line painting applications. Axle-spindle 142 is able to be unlocked for curved and circular-tracking painting applications.

Manually-operable striping system 100 may be sold as kit comprising the following parts: at least one the manually-operable striping assembly 110 at least one airless piston pump sprayer assembly 180; and at least one set of user instructions. The kit has instructions such that functional relationships are detailed in relation to the structure of the invention (such that the invention can be used, maintained, or the like in a preferred manner). Manually-operable striping system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different frame/wheel/paint delivery means and combinations, parts may be sold separately, etc., may be sufficient.

Figure 5:
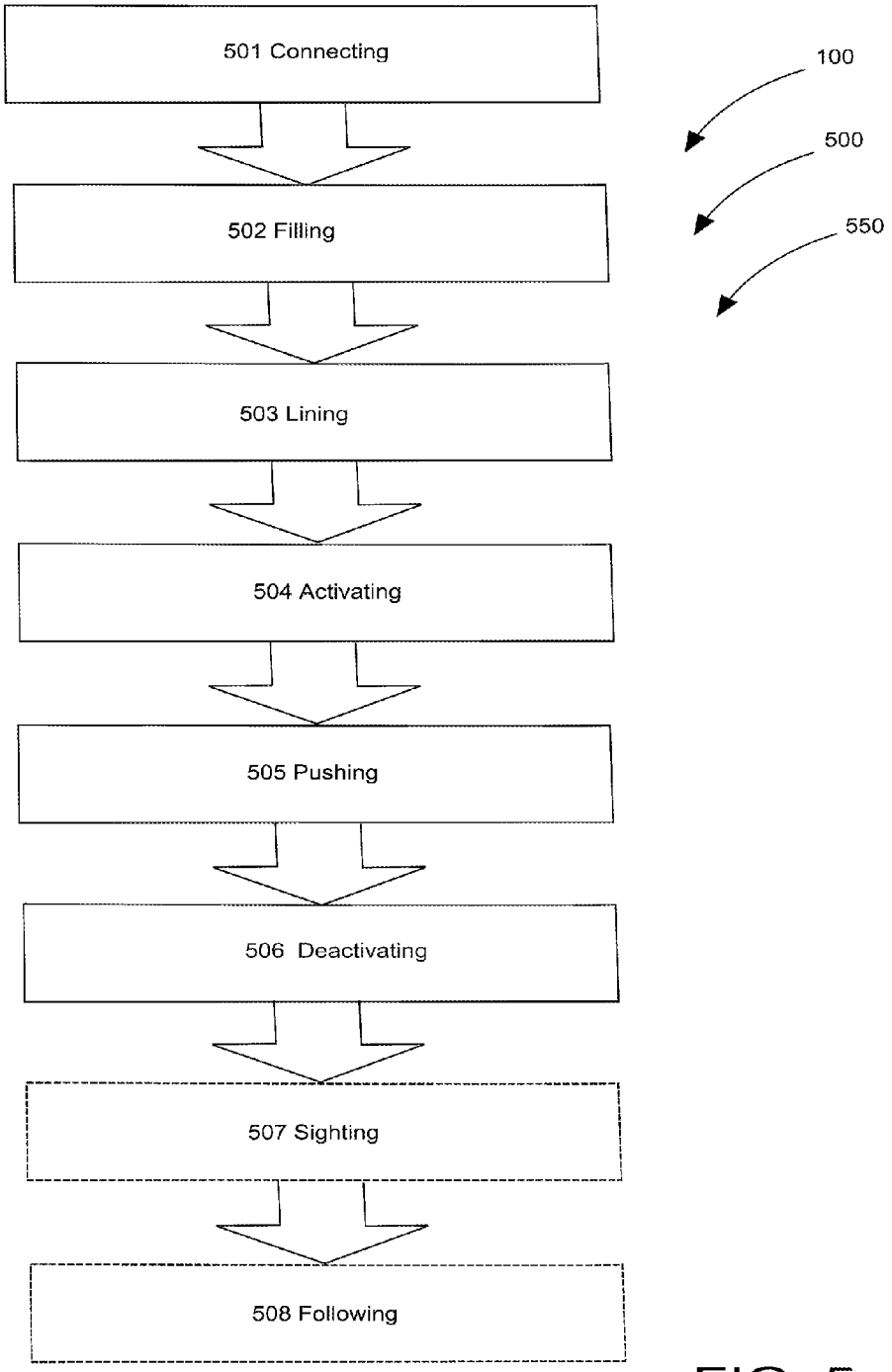
FIG. 5 is a flowchart illustrating a method of use for the manually-operable striping system according to an embodiment of the present invention of FIGS. 1-4.

Referring now to FIG. 5, a flowchart 550 illustrating a method of use 500 for manually-operable striping system 100 according to an embodiment of the present invention of FIGS. 1-4.

A method of using (method of use 500) a manually-operable striping system 100 may comprise the steps of: step one 501 connecting a manually-operable striping assembly 110 to airless piston pump sprayer assembly 180, step two 502 filling paint container 170 of airless piston pump sprayer assembly 180 ready for use, step three 503 lining up (positioning) manually-operable striping assembly 110 over a parking line 104 to be painted, step four 504 activating trigger assembly 186 to dispense paint onto parking line 104, and step five 505 manually pushing manually-operable striping assembly 110 while walking (following) to paint parking line 104, and step six 506 deactivating trigger assembly 186 to stop flow of the paint when parking line 104 has been painted. The method of use 500 may further comprise the seventh and eighth steps, respectively of sighting (507) and following (508) laser sighting device 160 to paint the parking line(s) 104.

It should be noted that steps 507 and 508 are optional steps and may not be implemented in all cases. Optional steps of method 500 are illustrated using dotted lines in FIG. 5 so as to distinguish them from the other steps of method 500.

It should be noted that the steps described in the method of use can be carried out in many different orders according to user preference. The use of "step of" should not be interpreted as "step for", in the claims herein and is not intended to invoke the provisions of 35 U.S.C. §112, ¶ 6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A manually-operable striping system comprising:
- a manually-operable striping assembly comprising;
  - a frame;
  - a rear-wheel-assembly having;
    - a first-frame-leg;
    - a first wheel;
    - a second-frame-leg; and
    - a second wheel;
  - a front-wheel-assembly having;
    - an axle-spindle; and
    - a third wheel;
  - a handle; and
  - an airless piston pump sprayer assembly having;
    - a spray nozzle shield;
    - a wand;
    - a trigger assembly;
    - a delivery hose; and
    - a paint container;
- wherein said spray nozzle shield of said airless piston pump sprayer assembly is positioned between and behind said first wheel and said second wheel of said rear-wheel-assembly, and on an opposite side of said rear-wheel-assembly from said third wheel of said front-wheel-assembly, such that when pushing said manually-operable striping assembly forward to create striping any overspray from said spray nozzle shield will not contact said first wheel and said second wheel of said rear-wheel-assembly and therefore will avoid inadvertent tracking or markings by said first wheel and said second wheel of said rear-wheel-assembly;
- wherein said manually-operable striping system comprises said manually-operable striping assembly;
- wherein said manually-operable striping assembly comprises in functional combination said frame, said rear-wheel-assembly, said front-wheel-assembly, and said handle;
- wherein said rear-wheel-assembly provides a means for operating said airless piston pump sprayer assembly to accurately paint at least one parking line;
- wherein said frame provides a mount for said rear-wheel-assembly, said front-wheel-assembly, and said handle;
- wherein said rear-wheel-assembly comprises in functional combination said first-frame-leg, said first wheel, said second-frame-leg, and said second wheel;
- wherein said first-frame-leg attaches said first wheel to said frame;
- wherein said second-frame-leg attaches said second wheel to said frame;

wherein said first wheel and said second wheel are located parallel to each other and behind said third wheel;

wherein said first wheel and said second wheel are situated so as to maintain stability during use and follow said third wheel when moving in a forward direction;

wherein said front-wheel-assembly comprises in functional combination said axle-spindle and said third wheel;

wherein said third wheel is able to provide steering;

wherein said rear-wheel-assembly and said front-wheel-assembly serve to provide motive means for said manually-operable striping system;

wherein said frame comprises a diamond-shaped perimeter with a bushing-extension suitable to receive said axle-spindle, said axle-spindle able to rotate within said bushing-extension to accommodate travel across a variety of terrains;

wherein said axle-spindle is situated along a substantially horizontal plane and is removable from said bushing-extension when desirable for storage;

wherein said handle is able to be moved in relation to said frame to appropriately manipulate said manually-operable striping assembly;

wherein said airless piston pump sprayer assembly comprises said spray nozzle shield, said wand, said trigger assembly, said delivery hose, said paint container all in fluid communication to deliver paint contained within said paint container to said delivery hose and into said wand when said trigger assembly is activated, said paint delivered through said spray nozzle shield for depositing said paint onto said at least one parking line;

wherein said wand is affixed adjacent said handle during use;

wherein said spray nozzle shield directs said paint downwardly onto said at least one parking line, protecting and sheltering said paint from being displaced inappropriately by said wind;

wherein said spray nozzle shield is located substantially perpendicular to said at least one parking line for painting; and wherein said manually-operable striping system is useful for painting said at least one parking line.

2. The manually-operable striping system of claim 1 further comprising a laser sighting device.

3. The manually-operable striping system of claim 1 wherein a plurality of wheels comprises exactly one of said first wheel, said second wheel, and said third wheel.

4. The manually-operable striping system of claim 1 wherein a travelling height of said manually-operable striping assembly is able to be adjusted by loosening connecting fasteners and moving said frame in relation to said rear-wheel-assembly.

5. The manually-operable striping system of claim 1 wherein said spray nozzle shield is located on a swivel at an end of said wand.

6. The manually-operable striping system of claim 1 wherein said wand when connected with said handle is able to be used in combination to steer said manually-operable striping assembly.

7. The manually-operable striping system of claim 1 wherein said manually-operable striping assembly comprises a mass of less than twenty pounds.

8. The manually-operable striping system of claim 1 wherein said axle-spindle is able to be locked for straight-line painting applications.

9. The manually-operable striping system of claim 1 wherein said axle-spindle is able to be unlocked for curved and circular-tracking painting applications.

10. The manually-operable striping system of claim 8 wherein said first wheel, said second wheel, and said third wheel do not pass over said at least one parking line during said straight-line painting applications.

11. The manually-operable striping system of claim 8 wherein said first wheel, said second wheel straddle said at least one parking line during said straight-line painting applications.

12. The manually-operable striping system of claim 2 wherein painting of said at least one parking line does not require use of chalk lines.

13. The manually-operable striping system of claim 1 wherein said first wheel, said second wheel, and said third wheel comprise rims with wheel bearings.

14. The manually-operable striping system of claim 1 wherein said first wheel, said second wheel, and said third wheel comprise rubber.

15. The manually-operable striping system of claim 1 wherein said axle-spindle comprises a half-wishbone structure to maximize steerability.

* * * * *